US008428280B2

(12) United States Patent
Cheng et al.

(10) Patent No.: US 8,428,280 B2
(45) Date of Patent: Apr. 23, 2013

(54) HEARING AID WITH AN INTERCHANGEABLE EARPIECE

(75) Inventors: Kim Hwee Cheng, Singapore (SG); Poh Chye Lim, Singapore (SG); Beng Hai Tan, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 288 days.

(21) Appl. No.: 12/836,715

(22) Filed: Jul. 15, 2010

(65) Prior Publication Data

US 2011/0013797 A1 Jan. 20, 2011

(30) Foreign Application Priority Data

Jul. 15, 2009 (DE) ..... 10 2009 033 316

(51) Int. Cl.
*H04R 25/00* (2006.01)

(52) U.S. Cl.
USPC ..... 381/322; 381/324; 381/87

(58) Field of Classification Search ..... 381/322
See application file for complete search history.

(56) References Cited

U.S. PATENT DOCUMENTS

| | | | | |
|---|---|---|---|---|
| 3,598,928 | A * | 8/1971 | Hickox | 381/324 |
| 4,069,400 | A | 1/1978 | Johanson et al. | |
| 4,920,570 | A | 4/1990 | West et al. | |
| 5,001,762 | A | 3/1991 | Barwig et al. | |
| 5,008,943 | A | 4/1991 | Arndt et al. | |
| 5,201,008 | A | 4/1993 | Arndt et al. | |
| 5,204,917 | A | 4/1993 | Arndt et al. | |
| 5,887,051 | A | 3/1999 | Sullivan et al. | |

(Continued)

FOREIGN PATENT DOCUMENTS

| | | |
|---|---|---|
| DE | 94 14 115 U1 | 10/1994 |
| DE | 103 45 173 B3 | 1/2005 |

(Continued)

OTHER PUBLICATIONS http://www.fujipoly.com/products/genProductLine.asp?ProductLine=Zebra; Copyright 2003-2009, Fujipoly America Corporation.

*Primary Examiner* — Christopher Uhlir
(74) *Attorney, Agent, or Firm* — Laurence A. Greenberg; Werner H. Stemer; Ralph E. Locher

(57) ABSTRACT

A hearing aid has an interchangeable earpiece, which, on its own and separately from further components, can be replaced in a simple fashion and without great complexity, and without specialist tools. The hearing aid has a housing of a multi-part design and a receiver and a signal processing device within the housing. The receiver is arranged detachably in a first housing part and the signal processing device is disposed in a further housing part and the two housing parts are detachably interconnected. A detachable locking mechanism connects the housing parts. The receiver is connected to the signal processing device by way of a detachable electrical connector with a receiver-side and a signal-processing-device-side electrical contact. At least one of the electrical contacts is elastic. Due to the fact that the housing parts, the electrical connection and the receiver are detachably assembled, this results in the possibility of, when necessary, interchanging the receiver on its own, separately from further components. It is not necessary to use specific components or even an adhesive. In the process, the elastic electrical contact for electrically connecting the receiver and signal processing device makes it easier to close the electrical connection when assembling the housing parts.

12 Claims, 5 Drawing Sheets

U.S. PATENT DOCUMENTS

| | | | | |
|---|---|---|---|---|
| 6,389,143 | B1 | 5/2002 | Leedom et al. | |
| 6,459,800 | B1 | 10/2002 | Brimhall | |
| 7,016,512 | B1 | 3/2006 | Feeley et al. | |
| 7,110,562 | B1 | 9/2006 | Feeley et al. | |
| 7,142,682 | B2 | 11/2006 | Müllenborn et al. | |
| 7,403,629 | B1 | 7/2008 | Aceti et al. | |
| 7,443,992 | B2 | 10/2008 | Fideler | |
| 7,536,023 | B2 | 5/2009 | Leedom et al. | |
| 7,561,708 | B2 | 7/2009 | Röhrlein | |
| 2002/0027996 | A1 | 3/2002 | Leedom et al. | |
| 2004/0141628 | A1 | 7/2004 | Villaverde et al. | |
| 2004/0240695 | A1 | 12/2004 | Leedom et al. | |
| 2005/0190940 | A1 | 9/2005 | Ach-Kowalewski et al. | |
| 2006/0153418 | A1* | 7/2006 | Van Halteren | 381/396 |
| 2007/0160255 | A1 | 7/2007 | Cheng et al. | |
| 2008/0273729 | A1 | 11/2008 | Saltykov et al. | |
| 2008/0298619 | A1* | 12/2008 | Kral et al. | 381/330 |

FOREIGN PATENT DOCUMENTS

| | | | |
|---|---|---|---|
| DE | 102004019353 | B3 | 9/2005 |
| DE | 10 2005 009 377 | B3 | 9/2006 |
| DE | 102005044416 | A1 | 3/2007 |
| DE | 10 2007 025936 | A1 | 12/2008 |
| DE | 603 18 107 | T2 | 12/2008 |
| DE | 102007054604 | A1 | 5/2009 |
| EP | 1 175 811 | A1 | 1/2002 |
| EP | 1394905 | A1 | 3/2004 |
| EP | 1569499 | A1 | 8/2005 |
| FR | 2 634 646 | A1 | 2/1990 |
| WO | 00/69216 | A2 | 11/2000 |

* cited by examiner

HEARING AID WITH AN INTERCHANGEABLE EARPIECE

CROSS-REFERENCE TO RELATED APPLICATION

This application claims the priority, under 35 U.S.C. §119, of German patent application DE 10 2009 033 316.9, filed Jul. 15, 2009; the prior application is herewith incorporated by reference in its entirety.

BACKGROUND OF THE INVENTION

Field of the Invention

The invention relates to a hearing aid with an interchangeable earpiece.

The earpiece or loudspeaker of a hearing aid is usually referred to as a receiver. The following text should be understood accordingly.

Hearing aids are used for supplying the hard-of-hearing with acoustic signals from the surroundings. The signals are processed and amplified in order to compensate for the respective hearing loss. A typical hearing aid comprises one or more microphones for registering the acoustic signals from the surroundings, a signal processing device for processing and amplifying the signals and a receiver for generating acoustic output signals for the ear of the hearing aid wearer. They usually contain further electrical components and an energy supply, which is usually implemented by a rechargeable or non-rechargeable battery. Additionally, hearing aids can also be used for treating hearing disorders, e.g. tinnitus, by generating e.g. compensating or covering or otherwise suitable acoustic signals for the ear of the hearing aid wearer. These can be tinnitus maskers, for example. In the following text, the term hearing aid is used equally for equipment for treating hearing disorders and hearing loss.

During their service life, the electrical components of a hearing aid are subjected to frequently changing influences from the surroundings as a result of climatic change. Additionally, they are subjected to contaminations and can become damp, e.g. during sport or in the rain. Contaminations, dampness and climatic change can lead to deterioration in the quality of the electrical components and corrosion of electrical connections. Additionally, the highly miniaturized components, in particular the receiver, can age due to the constant load from continuous use.

Hearing aids are used to treat hearing losses and hearing disorders with very different intensities. These can differ greatly from patient to patient, and additionally there are also changes over time in the hearing ability of one and the same person. Differences in the hearing ability require different processing and amplification of the output signals of a hearing aid. The differences from patient to patient and the differences over time in one and the same patient can in part be sufficiently accounted for by reprogramming the signal processing device. However, in the case of particularly large differences, particularly in respect of the required signal amplification, hardware changes may also become necessary, particularly the use of different receivers e.g. for higher sound volumes.

Aging, deterioration and changing requirements as a result of the respective hearing loss therefore make it desirable to be able to change the earpiece in a hearing aid. U.S. Pat. No. 7,016,512 B1 describes a so-called RIC-BTE (receiver in canal—behind the ear) hearing aid, in which the housing containing the electronic components is worn behind the ear, while the receiver is connected to the housing via a hearing tube and positioned in the auditory canal of the hearing aid wearer. The hearing tube is connected to the housing via a detachable plug-in connection. Interchanging the unit made of plug connector, tube and receiver is thus made possible.

Patent application publication US 2002/027996 A1 describes a CIC (completely in canal) hearing aid that has a partly modular design. The front-most part of the hearing aid facing the ear can be separated from the remainder of the housing. Here, it can contain the receiver, which is detachably connected by a plug-in connection to the other housing.

Commonly assigned German patent DE 10 2005 009 377 B3 describes an in-the-ear (ITE) hearing aid with a removable loudspeaker. The microphone and the amplifier of the hearing aid are housed in a first housing and the loudspeaker of the hearing aid is housed in a second housing. The two housings are detachably interconnected by a bayonet fastener.

U.S. Pat. No. 7,142,682 B2 and its counterpart European patent EP 1 574 112 B1 describe a hearing instrument with a silicon-based microphone configuration. The microphone configuration is arranged on a part that can be moved mechanically by hand. By way of example, the part can be an access flap.

German utility model G 94 14 115.0 (Gebrauchsmuster) describes a low-channel hearing aid with a removable loudspeaker. The loudspeaker and the remainder of the hearing aid are each housed in an individual housing. The two housings are detachably interconnected by a screw fastener.

Commonly assigned patent application publication US 2008/298619 A1 and its counterpart German published patent application DE 10 2007 025 936 A1 describe a hearing aid to which a tone hook can be fixedly attached. The hearing aid has a connection piece, by means of which the tone hook and a housing frame can be attached to one another. The attachment can be brought about by means of screw threads.

The prior art hearing aids only allow interchanging or replacing the receiver in conjunction with the respective housing part and further components of the hearing aid. However, it would be desirable for only the receiver, but not further components, to be interchanged in order to adapt to changed requirements or to compensate for deterioration due to age or use.

SUMMARY OF THE INVENTION

It is accordingly an object of the invention to provide a hearing aid with an exchangeable ear piece which overcome the above-mentioned disadvantages of the heretofore-known devices and methods of this general type and which provides for a hearing aid having an interchangeable earpiece, which, on its own and separately from further components, can be replaced in a simple fashion and without great complexity, and without specialist tools.

With the foregoing and other objects in view there is provided, in accordance with the invention, a hearing aid, comprising:

a multi-part housing formed with a plurality of detachably interconnected housing parts including a first housing part and a second housing part;

a detachable locking mechanism for locking the interconnected housing parts to one another;

a receiver detachably mounted in the first housing part;

a signal processing device disposed in the second housing part; and a detachable electrical connector connecting the receiver to the signal processing device, the detachable electrical connector having a receiver-side electrical contact and a signal-processing-device-side electrical contact, and wherein at least one of the electrical contacts is elastic.

A basic concept of the invention consists of a hearing aid comprising a housing of an at least two-part design and, within the housing, a receiver and a signal processing device, wherein the receiver thereof is arranged detachably in a first housing part and the signal processing device is arranged in a further housing part, wherein the two housing parts are detachably interconnected, wherein provision is made for a detachable locking mechanism, by means of which the interconnection between the housing parts is locked, and wherein the receiver is connected to the signal processing device by means of a detachable electrical connector, wherein the detachable electrical connector comprises a receiver-side and a signal-processing-device-side electrical contact, and wherein at least one of the electrical contacts is elastic.

By virtue of the fact that the housing parts of the hearing aid can be detached from one another, as can the electrical connection to the receiver, and that the receiver can be detached from the housing part housing it, this results in the possibility of, when necessary, interchanging the receiver on its own, separately from further components. The detachable connections of the components render unnecessary the use of special materials or even an adhesive. More particularly, no adhesively bonded housing needs to be opened and resealed after interchanging the receiver. The elastic electrical contact to the electrical connection between receiver and signal processing device simplifies the closing of the electrical connection in the process, and so only low requirements have to be placed on the precision with which the housing parts are interconnected when assembling the housing parts. Additionally, the elasticity of the electrical contact improves the durability or use over a multiplicity of receiver interchange processes because there cannot be a function-impairing permanent deformation, e.g. bending, of the electrical contacts of the connection.

An advantageous development of the basic idea consists of at least one elastic electrical contact containing conductive rubber.

Conductive rubber constitutes a material selection that can be handled particularly well, is cost effective and can be incorporated without difficulty. Here conductive rubber should be understood to mean a rubber or plastic that is filled with conductive particles and is suitable for conducting electricity. Carbon particles (e.g. graphite or soot), as conductive particles, are often used for filling.

A further advantageous development consists of the fact that at least one elastic electrical contact contains a plurality of alternating conductive rubber pieces and non-conductive rubber pieces arranged in parallel (zebra connector).

The alternating parallel design with conductive rubber pieces and non-conductive rubber pieces, which is also referred to as a zebra connector on account of its striped appearance, constitutes a particularly multi-faceted connector, since the alternating conducting and non-conducting rubber pieces result in a multiplicity of connection conduction-paths, which are electrically insulated from one another. A planar design of the respective opposite contact, with the contact area needing to have at least the extent of two rubber pieces, ensures that the zebra connector contacts a conductive rubber piece, independently of the precise positioning of the contact. This also allows a plurality of contacts, which are separated electrically from one another and are required in this way for actuating a receiver, to be connected without particular requirements in respect of the precision when being plugged together. For this, the extent of separation between the contacts merely has to be the extent of two rubber pieces in order to ensure that even in the case of the zebra connector there is an electrically insulating, non-conducting rubber piece between the electrically insulated contacts.

A further advantageous development consists of the fact the first and the further housing part are designed such that they can be detached from one another in a plug-in direction, and that the locking mechanism comprises a counter bearing extending transversely to the plug-in direction, a moveably mounted bolt meshing with the counter bearing in a mutual fashion and a bolt support guiding the bolt, which support is oriented transversely to the plug-in direction.

This results in a particularly simple plugging and locking construction, which simultaneously ensures a secure connection between the housing parts and good manageability when separating the housing parts.

A further advantageous development consists of the fact that the counter bearing is formed by an elongate groove, that the bolt is formed by a pin, and that the bolt support is designed such that the pin mounted in the bolt support can be inserted into the groove in the longitudinal direction.

An elongate groove forms a particularly stable counter bearing for a pin-shaped bolt because the mechanical stability is increased by the length of the groove and this increases the mutual meshing with the pin. At the same time, the groove supports the introduction or removal of the pin and this improves the handling.

A further advantageous development consists of the fact that the counter bearing is integrated in a contact component that carries one of the electrical contacts.

The integration of the counter bearing into the contact component contributes to miniaturizing the hearing aid by using components simultaneously for a plurality of functions. What is more, the arrangement of the counter bearing in the contact component increases the stability of the electrical connection between receiver and signal processing device, namely by virtue of the fact that the bolt and counter bearing join straight onto the electrical contact.

Other features which are considered as characteristic for the invention are set forth in the appended claims.

Although the invention is illustrated and described herein as embodied in a hearing aid with an interchangeable earpiece, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
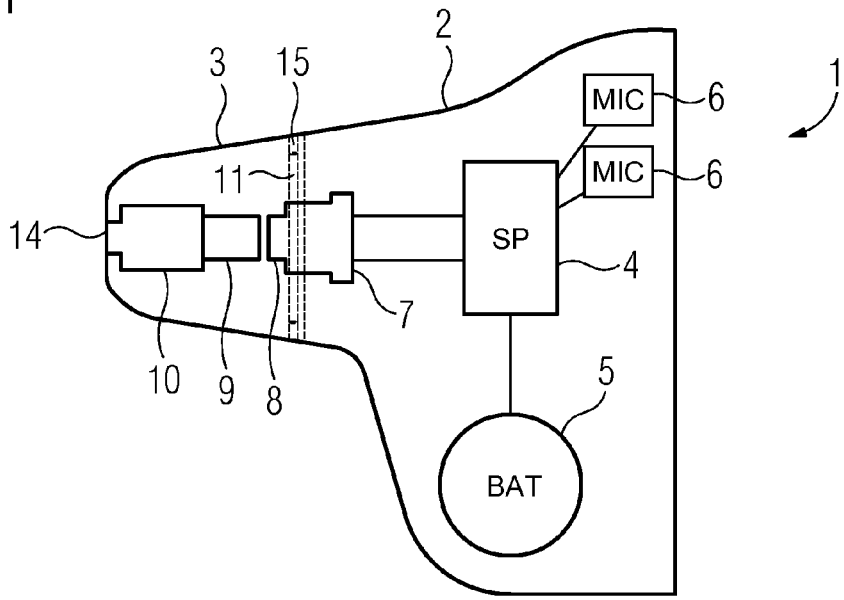
FIG. 1 is a diagram of a hearing aid with an interchangeable receiver according to the invention.

Referring now to the figures of the drawing in detail and first, particularly, to FIG. 1 thereof, there is shown a schematic illustration of a hearing aid 1 with an ITE (in the ear) design. A housing part 2 houses the primarily important electrical components of the hearing aid 1 with the exception of the receiver 10. A signal processing device is supplied with electrical energy by a battery 5. Microphones 6 supply it with acoustic signals from the surroundings as input signals, which are processed and amplified by the device. The processed and amplified signals are fed to the contact component 7 as an output signal. The contact component has a contact 8 that forms a part of an electrical connector.

The first housing part 3 houses the receiver 10, which comprises an electrical contact 9. The electrical contact 9 is connected to the electrical contact 8 and constitutes the electrical connector between the first housing part 3 and the further housing part 2, or between the receiver 10 and the signal processing device 4 (SP). The receiver outputs the acoustic output signal to the ear of the hearing aid wearer via a sound outlet opening 14 in the first housing part 3.

The receiver has been plugged into the first housing part 3 in a detachable fashion. The first housing part 3 is detachably connected to the further housing part 2 by having been plugged together. In order to avoid inadvertent release of the plug connection between housing part 2 and housing part 3, a pin 11, which itself can be detached, is provided as a bolt. The pin 11 in pushed into or, for releasing the locking mechanism, removed from lateral openings 15 in the housing part 3.

Figure 2:
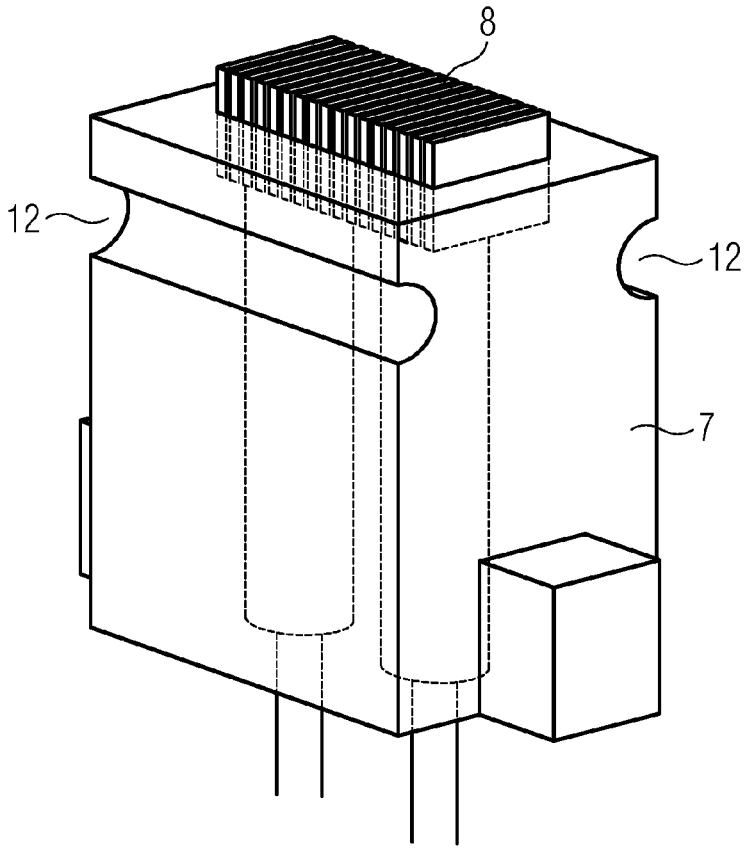
FIG. 2 is a perspective view of a contact component.

FIG. 2 illustrates the contact component 7. An electrical contact 8 is provided for establishing an electrical connection. Said contact is designed as a so-called zebra connector using so-called conductive rubber. Rubber that has been made to be electrically conductive by being filled with conductive particles such as graphite or soot is referred to as conductive rubber. In the zebra connector, pieces or plates of conductive rubber alternate with non-conducting rubber plates that are arranged alternately in parallel. This results in the striped pattern, which has led to the zebra labeling. Conductive rubbers and zebra connectors are known and can be obtained, for example, from Fujipoly (Fujipoly America).

Furthermore, the contact component 7 has two grooves that should serve as a counter bearing 12 for a pin that can be inserted or can be inserted into the grooves.

Figure 3:
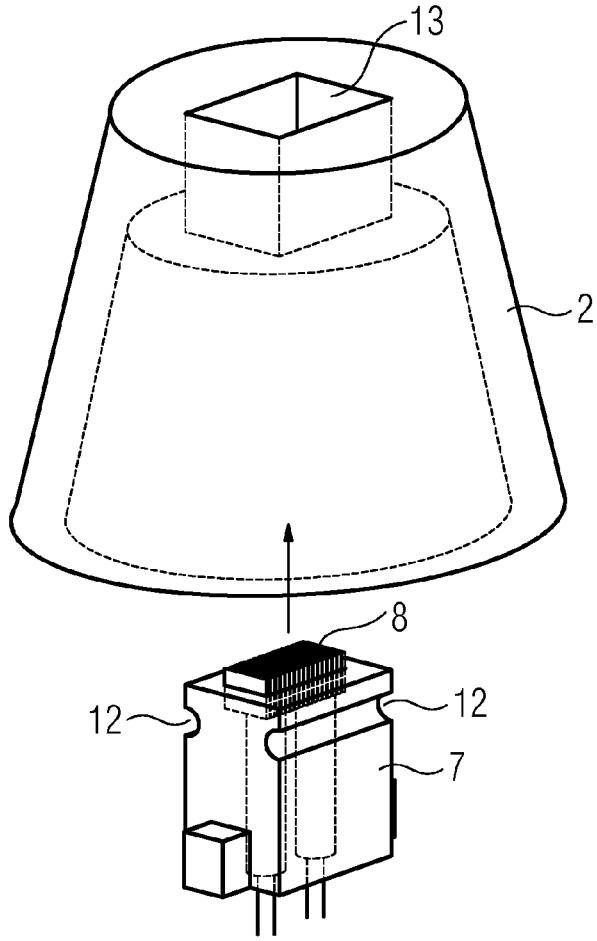
FIG. 3 is a perspective exploded view of a housing section and a contact component.

FIG. 3 illustrates the contact component 7 and a section of the further housing part 2. In the housing part 2 there is a connector opening 13, into which the contact component 7 can be inserted, as indicated by an arrow. As explained above, the contact component 7 comprises an electrical contact 8, designed as a zebra connector, and the two counter bearings 12.

Figure 4:
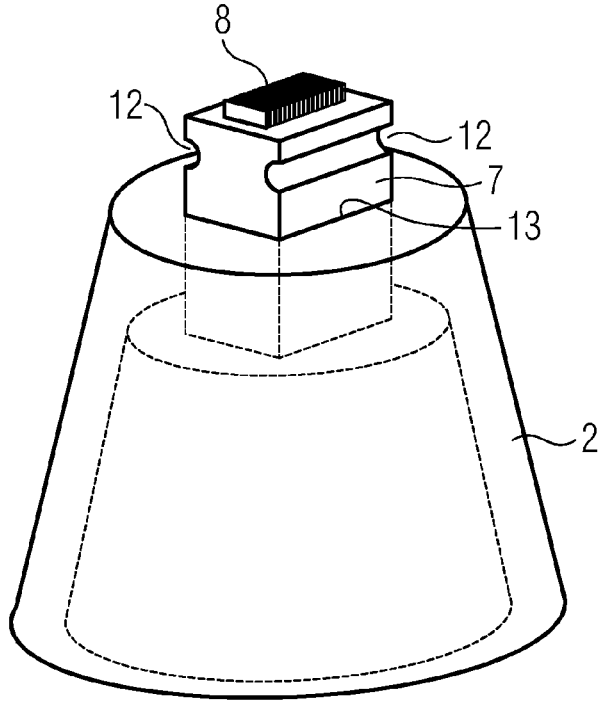
FIG. 4 is a perspective view of the housing section with an inserted contact component.

FIG. 4 illustrates the housing section 2 explained above, with a contact component 7 inserted into the connector opening 13. The electrical contact 8 clearly protrudes from the housing part 2, as do likewise the two counter bearings 12.

Figure 5:
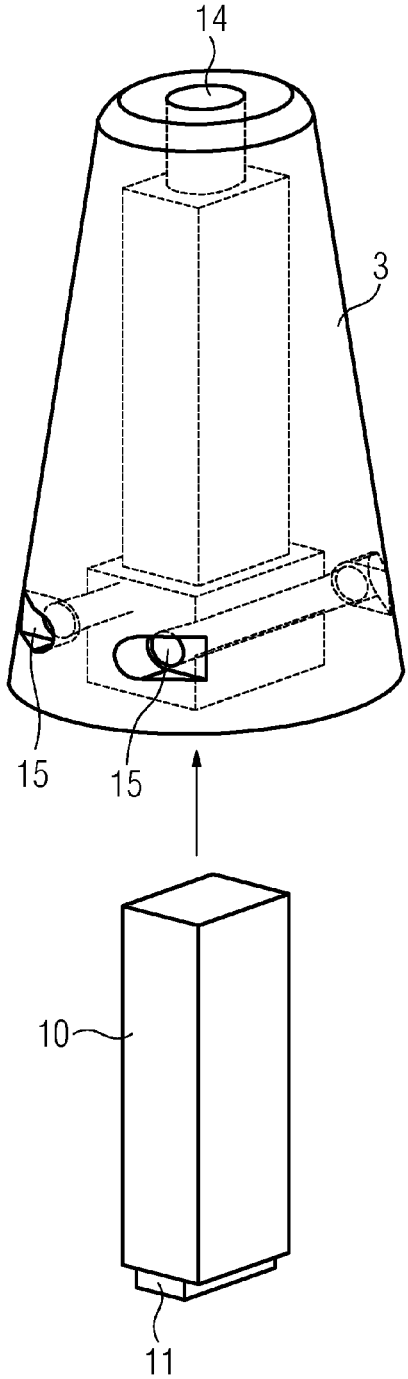
FIG. 5 is a perspective exploded view of a housing part and a receiver.

FIG. 5 illustrates the first housing part 3 and the receiver 10. The housing part has a sound outlet opening 14, into which or toward which the receiver 10 can be inserted into the housing part 3, as is indicated by an arrow. Furthermore, the housing part 3 has lateral openings 15, into which a pin can be inserted.

On its underside, the receiver 10 has an electrical contact 11, which is likewise designed as a zebra connector.

The electrical contact 11 is provided for the electrical connection to the above-described electrical contact 8 and, in principle, it suffices for only one of the two contacts 8 or 9 to be elastic. In this respect, it suffices for only one of the two contacts 8 or 9 to comprise conductive rubber or to be designed as a zebra connector. In an alternative embodiment, one or both contacts 8, 9 could be designed using elastic metal parts, which are designed as elastic contact tongues or contact springs. Of course, it is also feasible to use both a conductive rubber or zebra connector and an elastic metal contact in combination in an electrical connector.

Figure 6:
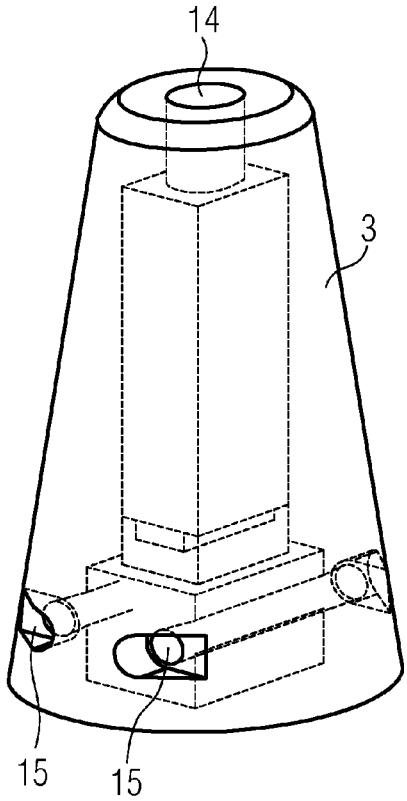
FIG. 6 is a perspective view of a housing part with an inserted receiver.

FIG. 6 illustrates the first housing part 3 with receiver 10 inserted therein. The receiver is connected to the sound outlet opening 14 in a sound-conducting fashion. The function of the lateral openings 15 will be explained below.

Figure 7:
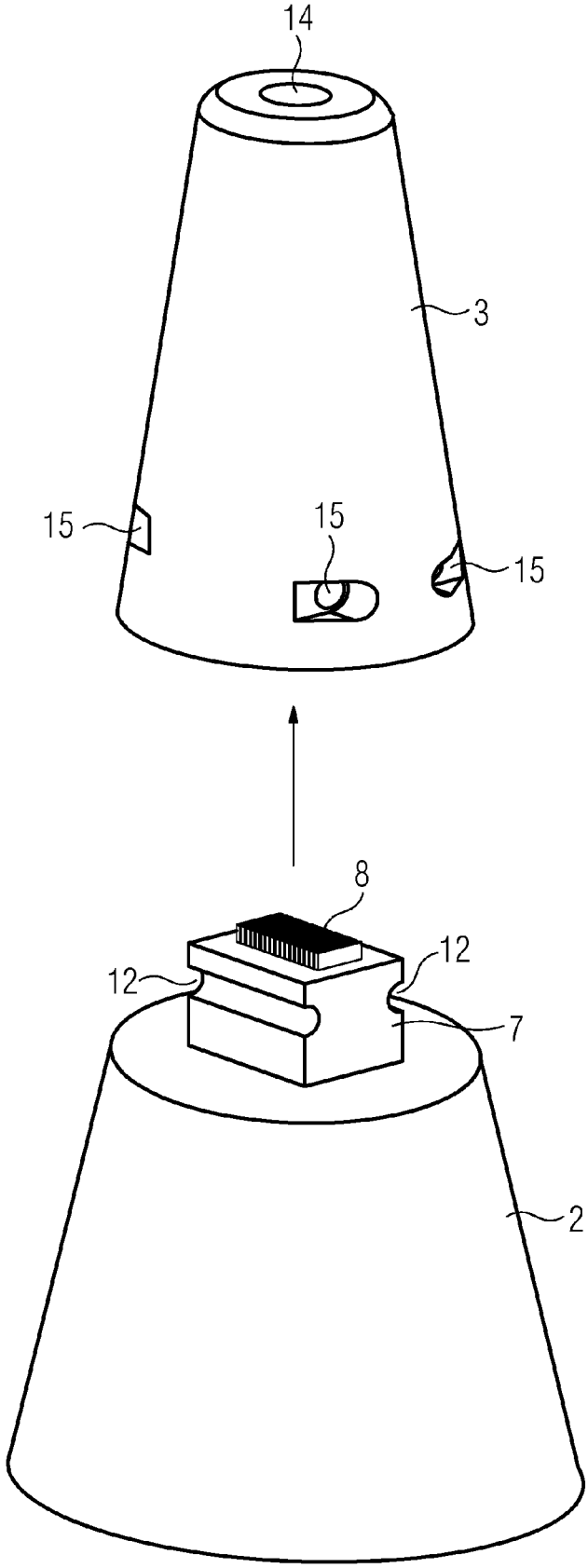
FIG. 7 is an exploded view of a first and a further housing part.

FIG. 7 illustrates the first housing part 3 with inserted receiver 10 and a section of the further housing part 2 with an inserted contact component 7. The housing parts 2 and 3, together with contact component 7 and receiver 10, situated on the inside, are designed such that they can be plugged into one another, as indicated by an arrow.

Figure 8:
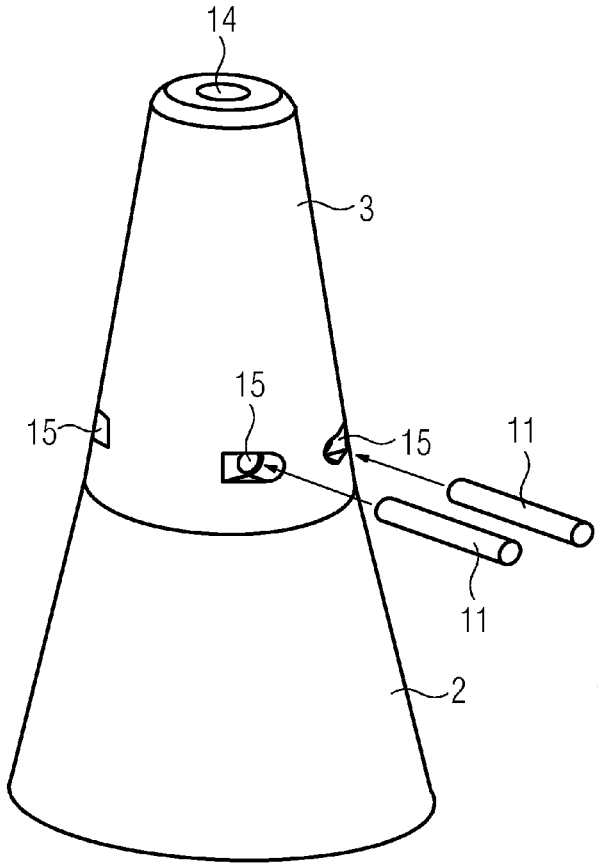
FIG. 8 is a perspective part of the housing parts plugged together, and two pins.

FIG. 8 illustrates the housing parts 2 and 3 plugged into one another, together with the pin 11 serving as a locking mechanism. The pin 11 can be inserted into the lateral opening 15 for locking, as indicated by an arrow. As clarified above, the contact component 7 has two counter bearings 12 arranged on both sides, and the first housing part 3 exhibits pairs of openings 15, each arranged laterally. The pin 11 is shaped such that, firstly, it can be pushed through the openings 15 and, secondly, it can mesh with the counter bearing 12. For this, the pin 11 has a circular cross section, while the respective counter bearing 12 has a semicircular cross section with a diameter that is not smaller than the diameter of the pin 11.

Depending on the design of the plug-in connection between the housing parts 2 and 3, a sufficiently secure locking of the plug-in connection can already be obtained when inserting a single pin 11. An increase in the stability of the locking mechanism is obtained by respectively inserting one pin 11 into both pairs of openings or both counter bearings 12. Here the pin or pins 11 are dimensioned such that they are seated in a slightly adhesive fashion in either the openings 15 or the counter bearing 12. This stops the pin or pins 11 from slipping out inadvertently and without assistance and thereby stops the locking mechanism between the housing parts 2 and 3 from being opened inadvertently and by accident. The adhesive seat of the pin or pins 11 is supported by the fact that the electrical connection of contacts 8 and 9 is also closed when the housing parts 2 and 3 are plugged together. Since at least one of the contacts 8 and 9 is elastic, the components are dimensioned such that the elastic force of the contact or contacts 8 and 9 is overcome during the plugging together. The elastic force of the contacts 8 and/or 9 compressed as a consequence thus exerts a force driving the housing parts 2 and 3 apart. This force leads to the pin or pins 11 being loaded via the openings 15 with a force that pushes said pin or pins into the respective counter bearing 12. Hence, the respective counter bearing 12 is indirectly loaded by the elastic force of the contact or contacts 8 or 9, which leads to the adhesive seat of the pin 11 and thereby prevents the latter from inadvertently sliding out.

Figure 9:
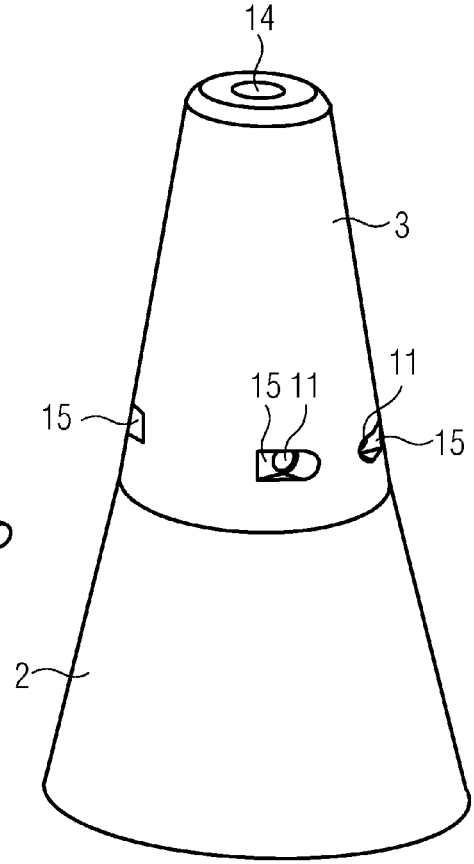
FIG. 9 shows the housing parts assembled and locked.

FIG. 9 illustrates the assembled housing parts 2 and 3, locked by pins 11.

A basic concept of the invention may be summarized as follows: The invention relates to a hearing aid with an interchangeable earpiece. The object of the invention is to specify a hearing aid with an interchangeable earpiece, which, on its own and separately from further components, can be replaced in a simple fashion and without great complexity, and without specialist tools. A basic idea of the invention consists of a hearing aid 1 comprising a housing of an at least two-part design and, within the housing, a receiver 10 and a signal processing device 4. The receiver 10 is arranged detachably in a first housing part 3 and the signal processing device 4 is arranged in a further housing part 2 and the two housing parts 2, 3 are detachably interconnected, wherein provision is made for a detachable locking mechanism of the mutual connection of the housing parts 2, 3. The receiver 10 is connected to the signal processing device 4 by means of a detachable electrical connector, wherein the detachable electrical connector comprises a receiver-side and a signal-processing-device-side electrical contact 8, 9, and wherein at least one of the electrical contacts 8, 9 is elastic. Due to the housing parts the electrical connection and the receiver itself being detachably assembled, this results in the possibility of, when necessary, interchanging the receiver on its own, separately from further components. It is not necessary to use specific components or even an adhesive. In the process, the elastic electrical contact for electrically connecting the receiver and signal processing device makes it easier to close the electrical connection when assembling the housing parts.

The invention claimed is:

1. A hearing aid, comprising:

a housing formed with a plurality of detachably interconnected housing parts including a first housing part and a second housing part;

a detachable locking mechanism for locking an interconnection between said housing parts;

a receiver detachably mounted in said first housing part;

a signal processing device disposed in said second housing part; and a detachable electrical connector connecting said receiver to said signal processing device, said detachable electrical connector having a receiver-side electrical contact and a signal-processing-device-side electrical contact, and wherein at least one of said electrical contacts is elastic and configured to exert a force on said detachable locking mechanism and to retain said locking mechanism in said housing when the hearing aid is fully assembled; and wherein said at least one elastic electrical contact is a zebra connector containing a plurality of alternating conductive rubber pieces and non-conductive rubber pieces arranged in parallel to one another.

2. The hearing aid according to claim 1, wherein said first and second housing parts are configured to be detached from one another in a plug-in direction, and said locking mechanism comprises a counter bearing extending transversely to the plug-in direction, a moveably mounted bolt meshing with the counter bearing in a mutual fashion, and a bolt support guiding said bolt, and wherein said bolt support is oriented transversely to the plug-in direction.

3. The hearing aid according to claim 2, wherein said counter bearing is an elongate groove, said bolt is a pin, and said bolt support enables said pin mounted in said bolt support to be inserted into said groove in a longitudinal direction thereof.

4. The hearing aid according to claim 2, wherein said counter bearing is integrated in a contact component carrying one of said electrical contacts.

5. The hearing aid according to claim 4, wherein said bolt support comprises at least two openings holding said pin, and said openings are formed in said first housing part carrying said receiver.

6. The hearing aid according to claim 3, wherein said bolt support comprises at least two openings holding said pin, and said openings are formed in said first housing part carrying said receiver.

7. A hearing aid, comprising:

a housing formed with a plurality of detachably interconnected housing parts including a first housing part and a second housing part;

a detachable locking mechanism for locking an interconnection between said housing parts;

a receiver detachably mounted in said first housing part;

a signal processing device disposed in said second housing part; and a detachable electrical connector connecting said receiver to said signal processing device, said detachable electrical connector having a receiver-side electrical contact and a signal-processing-device-side electrical contact;

wherein at least one of said electrical contacts is an elastic zebra connector containing a plurality of alternating conductive rubber pieces and non-conductive rubber pieces arranged in parallel to one another.

8. The hearing aid according to claim 7, wherein said first and second housing parts are configured to be detached from one another in a plug-in direction, and said locking mechanism comprises a counter bearing extending transversely to the plug-in direction, a moveably mounted bolt meshing with the counter bearing in a mutual fashion, and a bolt support guiding said bolt, and wherein said bolt support is oriented transversely to the plug-in direction.

9. The hearing aid according to claim 8, wherein said counter bearing is an elongate groove, said bolt is a pin, and said bolt support enables said pin mounted in said bolt support to be inserted into said groove in a longitudinal direction thereof.

10. The hearing aid according to claim 8, wherein said counter bearing is integrated in a contact component carrying one of said electrical contacts.

11. The hearing aid according to claim 10, wherein said bolt support comprises at least two openings holding said pin, and said openings are formed in said first housing part carrying said receiver.

12. The hearing aid according to claim 9, wherein said bolt support comprises at least two openings holding said pin, and said openings are formed in said first housing part carrying said receiver.

* * * * *